United States Patent [19]

de Beaumont et al.

[11] Patent Number: 4,528,972

[45] Date of Patent: Jul. 16, 1985

[54] EMERGENCY IGNITION DEVICE FOR THERMAL ENGINES WITH CONTROLLED IGNITION

[76] Inventors: Patrick de Beaumont, 119, rue N-D des Champs, 75006 Paris; Pierre Violante, 10, rue Marcel Lamour, 92230 Gennevilliers, both of France

[21] Appl. No.: 547,223

[22] Filed: Oct. 31, 1983

[30] Foreign Application Priority Data

Nov. 19, 1982 [FR] France ..... 82 19378

[51] Int. Cl.[3] ..... F02P 15/00

[52] U.S. Cl. ..... 123/640; 123/179 BG; 123/607

[58] Field of Search ..... 123/640, 641, 606, 607, 123/637, 639, 179 BG

[56] References Cited

U.S. PATENT DOCUMENTS

| | | | |
|---|---|---|---|
| 3,452,731 | 7/1969 | Becker | 123/641 |
| 4,000,729 | 1/1977 | Clark, Jr. | 123/640 |
| 4,207,851 | 6/1980 | Crisefi | 123/640 |
| 4,245,315 | 1/1981 | Barman et al. | 364/431 |
| 4,255,789 | 3/1981 | Hartford et al. | 364/431 |
| 4,364,344 | 12/1982 | Buetemeister | 123/179 BG |

FOREIGN PATENT DOCUMENTS

| | | | |
|---|---|---|---|
| 2619556 | 11/1977 | Fed. Rep. of Germany | 123/637 |
| 2081233 | 3/1971 | France . | |

*Primary Examiner*—Andrew M. Dolinar

*Attorney, Agent, or Firm*—Sandler & Greenblum

[57] ABSTRACT

An emergency ignition device for thermal engines with controlled ignition comprises an oscillator connected to a stabilized electrical supply and whose output is connected to a power transistor connected in series with the primary winding of the ignition coil. A normally open control switch is closed at the same time as the starter is actuated. Means are provided for modifying the operational frequency of the oscillator depending on whether the control switch is open or closed, so that the oscillator operates at a first relatively low frequency as long as the control switch is closed and at a second frequency higher than the preceding one when the switch is open. A time delay circuit is connected to the oscillator and the control switch so as to inhibit operation of the oscillator during a predetermined period of time after the instant of closure of the control switch.

1 Claim, 2 Drawing Figures

EMERGENCY IGNITION DEVICE FOR THERMAL ENGINES WITH CONTROLLED IGNITION

BACKGROUND OF THE INVENTION

The present invention relates to an emergency ignition device for thermal engines with controlled ignition.

The engines of automobile vehicles are generally of the type controlled ignition and to this end they comprise, except for Diesel engines, one spark plug per cylinder, these spark plugs being supplied with high voltage from the secondary winding of an ignition coil, via the rotor of a distributor. It is known that these ignition devices eventually give rise to a certain number of breakdowns which may be due to the contact breaker, the capacitor, the coil or, if they exist, to the electronic modules of the broken-down vehicle. Emergency repair of these engines is traditionally carried out by professionals, but in the majority of cases, there is no other solution than to tow the vehicle to a repair shop.

SUMMARY OF THE INVENTION

It is an object of the present invention to overcome these drawbacks by providing an emergency ignition device of low cost price which enables an automobile vehicle to be very easily repaired.

To this end, this emergency ignition device for thermal engines with controlled ignition, the ignition circuit comprising an ignition coil, to the secondary winding of which the spark plugs of the various cylinders of the engine are connected, is characterized in that it comprises an oscillator connected to a stabilized electrical supply and whose output is connected to a power transistor connected in series with the primary winding of the ignition coil, a normally open control switch which is closed at the same time as the starter is actuated, means for modifying the operational frequency of the oscillator depending on whether the control switch is open or closed, so that the oscillator operates at a first relatively low frequency as long as the control switch is closed and at a second frequency higher than the preceding one when the switch is open, and a time delay circuit connected to the oscillator and the control switch so as to inhibit operation of the oscillator during a predetermined period of time after the instant of closure of the control switch and then to allow the oscillator to operate at the first relative low frequency as long as the control switch is maintained closed, i.e. as long as the starter is actuated to rotate the engine.

The emergency ignition device according to the invention offers the advantage that it enables an engine to start up again whatever the faults which appeared in the normal ignition circuit.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1:
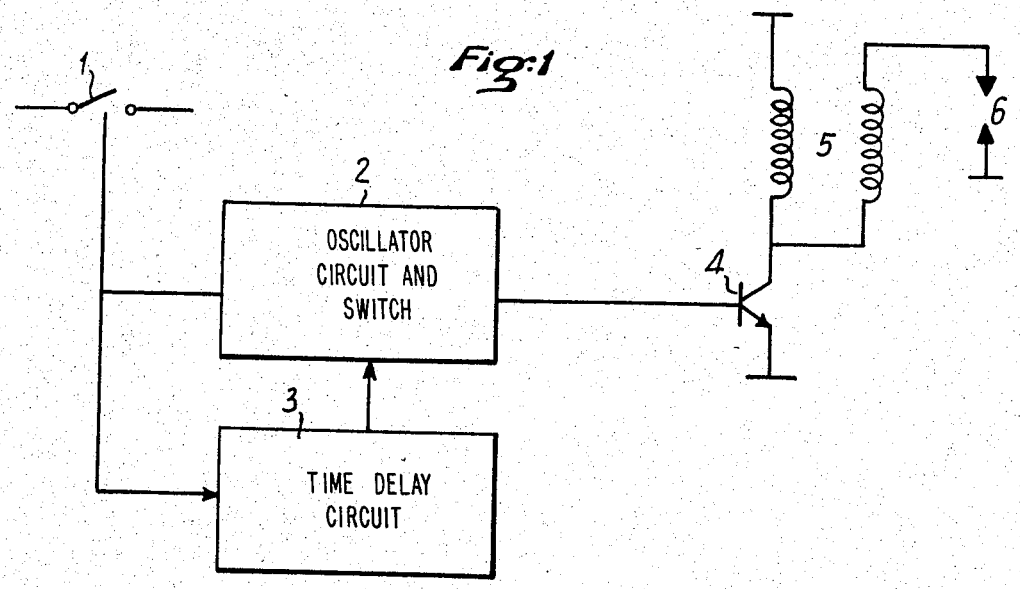
FIG. 1 is a block diagram of an emergency ignition device according to the invention.

Referring now to the drawings, the emergency ignition device according to the invention comprises a control switch 1 which is connected in parallel to a switch and oscillator circuit 2 and to a time delay circuit 3 acting thereon.

The output of the switch-oscillator circuit 2 is connected to the base of a power transistor 4 whose emitter-collector circuit is connected in series with an ignition coil 5 supplying, via a distributor, the ignition spark plugs 6 placed in the various cylinders of the engine.

Figure 2:
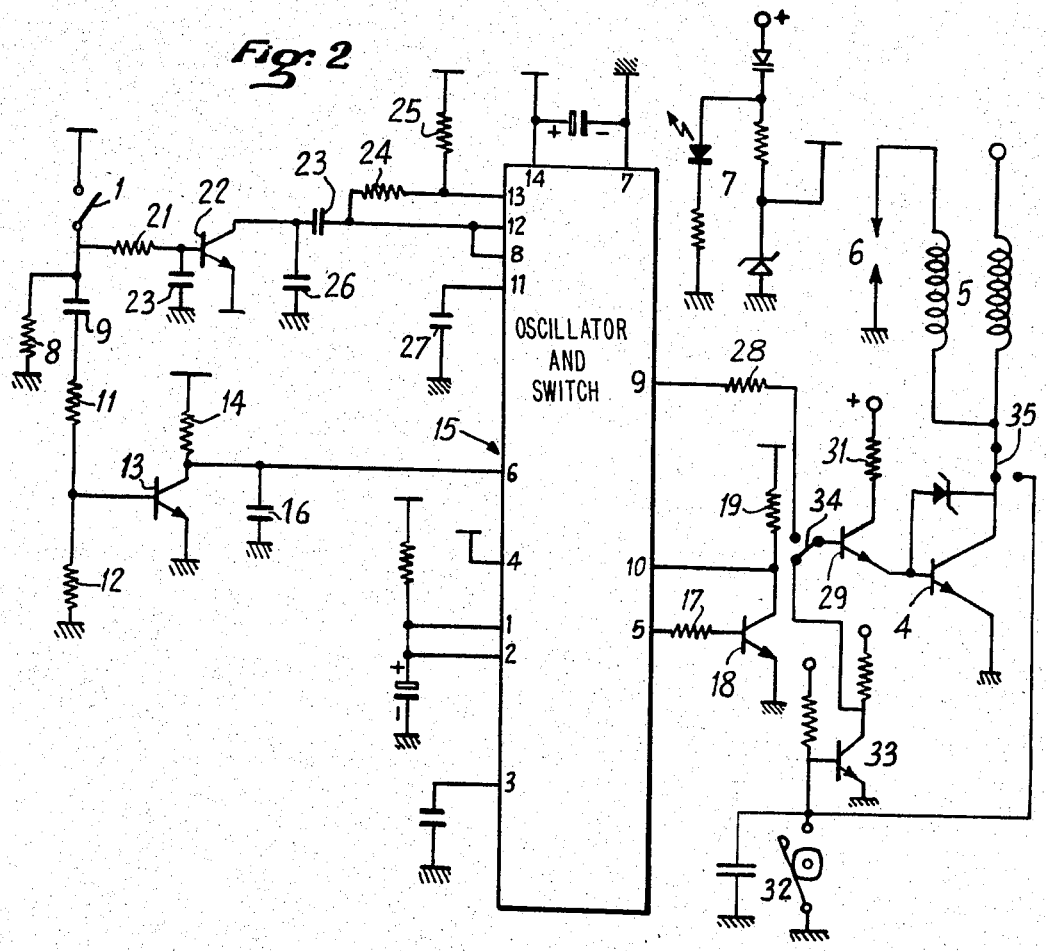
FIG. 2 is an electrical diagram of a particular embodiment of the emergency ignition device.

In FIG. 2 which shows in detail the diagram of an embodiment of the device indicated schematically in FIG. 1, the control switch 1 which is normally open, is connected between the positive pole of a stabilized supply circuit 7 and earth, on the one hand by a resistor 8 and on the other hand by a capacitor 9 and two resistors 11, 12 in series. The point of junction between resistors 11, 12 is connected to the base of a transistor 13 whose emitter is connected to earth and whose collector is connected on the one hand to the positive pole of the supply, by a resistor 14, and on the other hand to a terminal "6" of an integrated circuit 15 of type LM 556 manufactured by National Semiconductors. The integrated circuit 15 performs the functions of time-delay, switching and oscillation. The collector of transistor 13 is also connected to earth by a capacitor 16.

The terminal "5" of the integrated circuit 15 is connected, by a resistor 17, to the base of a transistor 18 whose emitter is connected to earth and whose collector is connected on the one hand to the positive pole of the supply, by a resistor 19, and on the other hand to the terminal "10" of the integrated circuit 15.

Furthermore, the control switch 1 is also connected, by a resistor 21, to the base of a transistor 22 which is connected to earth by a capacitor 23. The emitter of this transistor 22 is connected to earth whilst its collector is connected to the terminal "12" of the integrated circuit 15, by a capacitor 23, and also to terminal 13, by a resistor 24, this terminal 13 also being connected to the positive pole of the supply by a resistor 25. The collector of the transistor 22 is also connected to earth by a capacitor 26. The terminal 11 of the integrated circuit 15 is connected to earth by a capacitor 27.

The output terminal 9 of the integrated circuit 15 is connected, by a resistor 28, to the base of a transistor 29 whose collector is connected to the positive pole of the battery by a resistor 31 and whose emitter is connected to the base of the power transistor 4.

The emergency device which has just been described operates as follows:

When the control switch 1 is open, the integrated circuit 15 operates partly as an oscillator and it delivers at its output terminal "9" an alternating current of frequency equal to 200 Hz for example which is aplied, after amplification by the power transistor 4, to the ignition coil 5 and to the spark plugs 6.

The user closes the control switch 1 at the same time as actuating the starter. The effect of this is to apply to the integrated circuit 15, by the transistor 13, a pulse of short duration, this pulse being transmitted to terminal "6" of the integrated circuit 15. This results in a level signal at terminal "5" which causes the transistor 18 to pass to the current-carrying state and the signal of the collector thereof which is applied to terminal "10" of the integrated circuit 15 provokes blockage of the part constituting the oscillator. In other words, as soon as the control switch 1 is closed, the emission of the A.C. signal at the output terminal "9" of the integrated circuit 15 is eliminated. As the user actuates the starter, at the same time as closing the control switch 1, the engine therefore rotates during a certain period of time without the ignition coil 5 having an alternating current passing therethrough.

At the end of the predetermined period of time, the inhibition signal applied to the terminal "10" disappears and the oscillator resumes operation. However, its frequency is then lower with respect to the initial frequency, as the transistor 22 has been rendered conductive further to the closure of switch 1. This has for its effect to short circuit the capacitor 26 and to lower the frequency of the oscillator. For example, if the initial frequency is 200 Hz, the frequency then furnished to the output terminal "9" drops to 100 Hz. The signal of frequency 100 Hz is then applied, by transistor 29, to the power transistor 4 and then, after amplification, to the ignition coil 5 and to the spark plugs 6. This low frequency signal is applied until the engine starts up. At that moment, the driver of the vehicle releases the control switch 1 so that the oscillator then operates at the higher frequency of 200 Hz which is better adapted to the normal running of the engine, the low frequency of 100 Hz being suitable for the period of starting the engine.

The device according to the invention may be used either with the ignition coil 5 of the vehicle or with its own coil.

It may also be used permanently in conjunction with a conventional ignition 32 with contact breaker or with an electronic ignition 33. Switches 34 and 35 enable the electronic ignition 33, the conventional ignition 32 or the emergency ignition device according to the invention to be put into operation. Switch 34 is connected between the base of transistor 29 and on the one hand the resistor 28 and on the other hand a transistor forming part of the electronic ignition 33. Furthermore, the contact breaker of the conventional ignition device 32 is connected on the one hand to the transistor of the electronic ignition 33 and on the other hand to the switch 35 which is connected between the power transistor 4 and the ignition coil 5.

What we claim is:

1. An emergency ignition device for thermal engines with controlled ignition, wherein said engine comprises a starter, a plurality of cylinders, and a plurality of spark plugs connected to said cylinders, wherein said device comprises an ignition circuit comprising:

(a) an ignition coil having a primary and a secondary winding connected to said spark plugs of said plurality of cylinders of the engine;

(b) an oscillator adapted to operate at a first relatively low frequency and a second frequency higher than said first frequency;

(c) a stabilized electrical supply, connected to said oscillator;

(d) a power transistor connected in series with said primary winding of said ignition coil, wherein the output of said oscillator is connected to said power transistor;

(e) a control switch, biased into an open position, wherein said switch is adapted to be closed at the same time and as long as said starter is actuated to rotate the engine;

(f) means for modifying the operational frequency of said oscillator, depending on whether said control switch is open or closed, so that said oscillator operates at said first frequency as long as said control switch is closed and at second frequency when said switch is open; and (g) a time delay circuit connected to said oscillator and said control switch so as to inhibit operation of the oscillator during a predetermined period of time after the instant of closure of said control switch and then to allow said oscillator to operate at said first frequency as long as said control switch is maintained closed.

* * * * *